US006926589B2

(12) United States Patent
Young et al.

(10) Patent No.: US 6,926,589 B2
(45) Date of Patent: Aug. 9, 2005

(54) CHEMICAL MECHANICAL POLISHING APPARATUS AND METHODS USING A FLEXIBLE PAD AND VARIABLE FLUID FLOW FOR VARIABLE POLISHING

(75) Inventors: Douglas W. Young, Sunnyvale, CA (US); Brett E. McGrath, San Jose, CA (US); Yuchun Wang, San Jose, CA (US)

(73) Assignee: ASM Nutool, Inc., Fremont, CA (US)

( * ) Notice: Subject to any disclaimer, the term of this patent is extended or adjusted under 35 U.S.C. 154(b) by 68 days.

(21) Appl. No.: 10/105,016

(22) Filed: Mar. 22, 2002

(65) Prior Publication Data

US 2003/0181143 A1 Sep. 25, 2003

(51) Int. Cl.[7] ..... B24B 1/00

(52) U.S. Cl. ..... 451/41; 451/8; 451/24; 451/60; 451/285; 451/286; 451/287; 451/288; 451/296; 451/303; 451/306; 451/307; 451/446

(58) Field of Search ..... 451/8, 24, 41, 451/60, 285, 286, 287, 288, 296, 303, 306, 307, 446

(56) References Cited

U.S. PATENT DOCUMENTS

| | | | | | |
|---|---|---|---|---|---|
| 5,558,568 | A | * | 9/1996 | Talieh et al. | 451/303 |
| 5,916,012 | A | * | 6/1999 | Pant et al. | 451/41 |
| 6,248,000 | B1 | * | 6/2001 | Aiyer | 451/41 |
| 6,302,767 | B1 | * | 10/2001 | Tietz | 451/41 |
| 6,322,427 | B1 | * | 11/2001 | Li et al. | 451/56 |
| 6,520,833 | B1 | * | 2/2003 | Saldana et al. | 451/5 |
| 6,656,030 | B2 | * | 12/2003 | Xu et al. | 451/526 |

* cited by examiner

*Primary Examiner*—Joseph J. Hail, III
*Assistant Examiner*—Shantese McDonald
(74) *Attorney, Agent, or Firm*—Knobbe Martens Olson & Bear LLP

(57) ABSTRACT

The present invention relates to methods and apparatus that allow for chemical mechanical polishing using a flexible pad and variable fluid flow for variable polishing.

24 Claims, 4 Drawing Sheets

CHEMICAL MECHANICAL POLISHING APPARATUS AND METHODS USING A FLEXIBLE PAD AND VARIABLE FLUID FLOW FOR VARIABLE POLISHING

BACKGROUND OF THE INVENTION

1. Field of the Invention

The present invention relates to the field of chemical mechanical polishing. More particularly, the present invention relates to methods and apparatus that allow for chemical mechanical polishing using a flexible pad and variable fluid flow for variable polishing.

2. Description of the Related Art

Chemical mechanical polishing (CMP) of materials for VLSI and ULSI applications has important and broad application in the semiconductor industry. CMP is a semiconductor wafer flattening and polishing process that combines chemical removal of layers such as insulators, metals, and photoresists with mechanical polishing or buffing of a wafer layer surface. CMP is generally used to flatten surfaces during the wafer fabrication process, and is a process that provides global planarization of the wafer surface. For example, during the wafer fabrication process, CMP is often used to flatten/polish the profiles that build up in multilevel metal interconnection schemes. Achieving the desired flatness of the wafer surface must take place without contaminating the desired surface. Also, the CMP process must avoid polishing away portions of the functioning circuit parts.

U.S. Pat. No. 6,103,628, assigned to the assignee of the present invention, describes a reverse linear chemical mechanical polisher that operates to use a reverse linear motion to perform chemical mechanical polishing. In use, a rotating wafer carrier within a polishing region holds the wafer being polished.

U.S. patent application Ser. No. 09/684,059, filed Oct. 6, 2000 and which is a continuation-in-part of U.S. Pat. No. 6,103,628, describes various features of a reverse linear chemical mechanical polisher, including a platen support in the polishing region that uses a fluid such as air or magnetic films to levitate the polishing pad off of the platen support while the pad moves with reverse linear motion at the desired speed above the platen support.

In a linear polisher, U.S. Pat. No. 5,916,012 describes using a support housing that underlies an endless loop belt and to which a polishing pad is attached on the outer surface of the endless loop belt, with the support housing including a plurality of openings for dispensing a pressurized fluid. These openings are configured into different concentric and pie-shaped groupings that can each be separately and independently controlled in order to apply a different amount of pressurized fluid to corresponding portions of the polishing pad. The endless loop belt, as actually implemented in practice, was made of stainless steel, to which an adhesive was applied to allow a polishing material to attach thereto. In operation, although the pressurized fluid can be varied with respect to the various concentric and pie-shaped concentric groupings, the rigidity of the stainless steel inner endless loop prevents the ejected pressurized fluid from significantly impacting the polishing effect at a particular location of the wafer being polished. While certain localized pressure variations may have been possible when practicing the '012 patent, the local control that may have been achievable was still not sufficiently localized to correct for variations that occur millimeters apart.

The present inventors have determined, however, that it would be advantageous to provide for a reverse linear polisher that uses a flexible and relatively light polishing pad and variable fluid flow for polishing of a wafer in order to control the polishing profile at various locations on the wafer. Accordingly, further improvements as described herein are described.

SUMMARY OF THE INVENTION

The present invention offers many advantages, including the ability to efficiently regulate a desired degree of polish on various portions of a wafer being polished.

Another advantage is that the present invention allows for a uniformly flat surface by controlling the amount of polishing at different portions of a wafer based upon dynamically obtained signals indicative of planarity of the wafer surface.

Another advantage is the ability to control the amount of polishing at different portions of a wafer using a controlled fluid flow.

The present invention provides the above advantages with a method and apparatus for bi-directional linear polishing that uses a flexible pad and variable fluid flow for variable polishing of different portions of a wafer. In one aspect, a platen support includes various regions with opening through which a fluid is expelled toward a backside of the flexible pad. Each of the various regions is independently controlled, thus allowing the fluid flow corresponding to that region to significantly impact the amount of polishing that occurs on a portion of a wafer that is disposed to face a frontside of the flexible pad and corresponds to that region.

BRIEF DESCRIPTION OF THE DRAWINGS

The above and other objectives, features, and advantages of the present invention are further described in the detailed description which follows, with reference to the drawings by way of non-limiting exemplary embodiments of the present invention, wherein like reference numerals represent similar parts of the present invention throughout several views and wherein:

FIG. 3 illustrates the velocity change using a bi-directional linear polisher according to the present invention; and.

DETAILED DESCRIPTION OF THE PREFERRED EMBODIMENT

Figure 1:
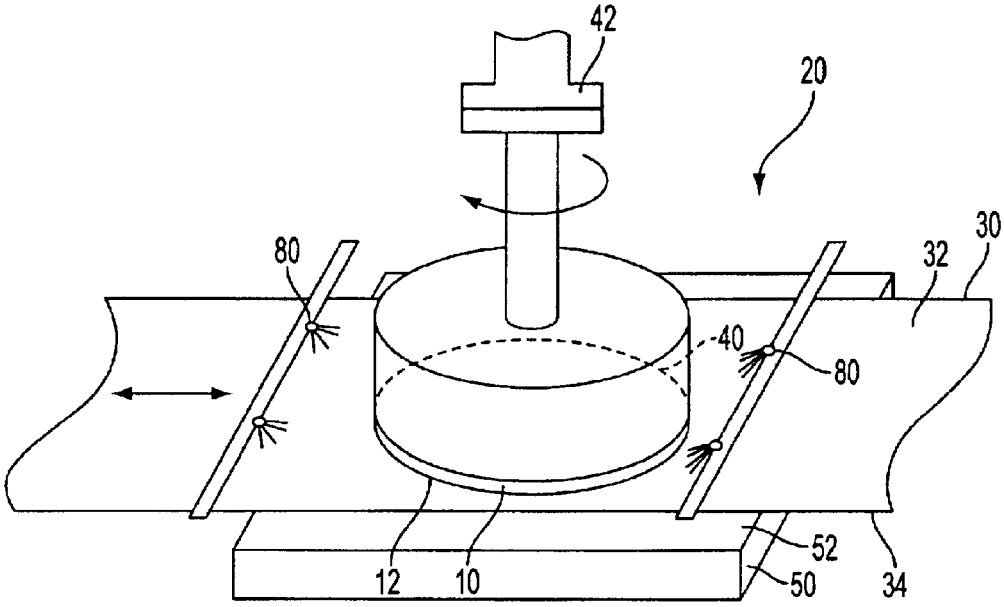
FIG. 1 illustrates a bi-directional linear polisher according to the present invention.

U.S. Pat. Nos. 6,103,628 and 6,468,139, both of which are hereby expressly incorporated herein by reference, together describe, in one aspect, a reverse linear polisher 20 that can use a polishing pad to polish a wafer 10. As illustrated in FIG. 1, a processing area as described in the above references is illustrated. The bi-directional linearly moving pad 30 for polishing a front wafer surface 12 of a wafer 10 is driven by a drive mechanism (not shown). The wafer 10 is held in place by a wafer carrier 40, which wafer carrier 40 preferably holds the wafer in place, and can also rotate during a polishing operation as described herein.

Below the pad 30 is a platen support 50. During operation, due to a combination of tensioning of the pad 30 and the emission of a fluid, such as air, water, or a combination of different fluids from openings 54 (see FIG. 2) disposed in the top surface 52 the platen support 50, a portion of the pad 30 is supported above the platen support 50 in a processing area, such that a frontside 32 of the pad 30 contacts the front surface 12 of the wafer 10, and the backside 34 of the pad 30 levitates over the top surface 52 of the platen support 50. While the portion of the pad 30 within the processing area moves in a bi-linear manner, the two ends of the pad 30 are preferably connected to source and target spools, allowing for incremental portions of the pad 30 to be placed into and then taken out of the processing area, as described in U.S. Pat. No. 6,468,139 referenced above.

Further, during operation, various polishing agents without abrasive particles or slurries with abrasive particles can be introduced, depending upon the type of pad 30 and the desired type of polishing, using nozzles 80. For example, the polishing pad 30 can contain abrasives embedded in the frontside 32 with polishing agents but not a slurry being introduced, or can use a polishing pad 30 that does not contain such embedded abrasives and instead uses a slurry, or can use some other combination of pad, slurry and/or polishing agents. The polishing agent or slurry may include a chemical that oxidizes the material that is then mechanically removed from the wafer. A polishing agent or slurry that contains colloidal silica, fumed silica, alumina particles etc., is generally used with an abrasive or non-abrasive pad. As a result, high profiles on the wafer surface are removed until an extremely flat surface is achieved.

While the polishing pad can have differences in terms of whether it contains abrasives or not, any polishing pad 30 according to the present invention needs to be sufficiently flexible and light so that a variable fluid flow from various openings 54 on the platen support can affect the polishing profile at various locations on the wafer. Further, it is preferable that the pad 30 is made from a single body material, which may or may not have abrasives impregnated therein. By single body material is meant a single layer of material, or, if more than one layer is introduced, maintains flexibility such as obtained by a thin polymeric material as described herein. An example of a polishing pad that contains these characteristics is the fixed abrasive pad such as MWR66 marketed by 3M company that is 6.7 mils thick and has a density of 1.18 g/cm$^3$. Such polishing pads are made of a flexible material, such as a polymer, that are typically within the range of only 4–15 mils thick. Therefore, fluid that is ejected from the openings 54 on the platen support 50 can vary by less than 1 psi and significantly impact the amount of polishing that will occur on the front face 12 of the wafer 10 that is being polished, as explained further hereinafter. With respect to the pad 30, the environment that the pad 30 is used in, such as whether a linear, bi-linear, or non-constant velocity environment will allow other pads to be used, although not necessarily with the same effectiveness. It has been determined, further, that pads having a construction that has a low weight per cm$^2$ of the pad, such as less than 0.5 gm/cm2, coupled with the type of flexibility that a polymeric pad achieves, also can be acceptable.

Another consideration with respect to the pad 30 is its width with respect to the diameter of the wafer 10 being polished, which width can substantially correspond to the width of the wafer 10, or be greater or less than the width of the wafer 10.

As will also be noted hereinafter, the pad 30 is preferably substantially optically transparent at some wavelength, so that a continuous pad 30, without any cut-out windows, can allow for detection of the removal of a material layer (end point detection) from the front surface 12 of the wafer 10 that is being polished, and the implementation of a feedback loop based upon the detected signals in order to ensure that the polishing that is performed results in a wafer 10 that has all of its various regions polished to the desired extent.

Before explaining further the relationship between the fluid ejection pressure and the pad 30, a further description of the platen support 50 is provided. Preferably, the platen support 50 is made of a hard and machineable material, such as titanium, stainless steel or hard polymeric material. The machineable material allows formation of the holes 54, as well as channels that allow the fluid to e transmitted through the platen support 50 to the holes 54. With the fluid that is ejected from the openings 54, the platen support 50 is capable of levitating the pad. In operation, the platen support 50 will provide for the ejection of a fluid medium, preferably air, but water or some other fluid can also be used. This ejected fluid will thus cause the bi-linearly moving pad 30 to levitate above the platen support 50 and pushed against the wafer surface when chemical mechanical polishing is being performed.

Figure 2:
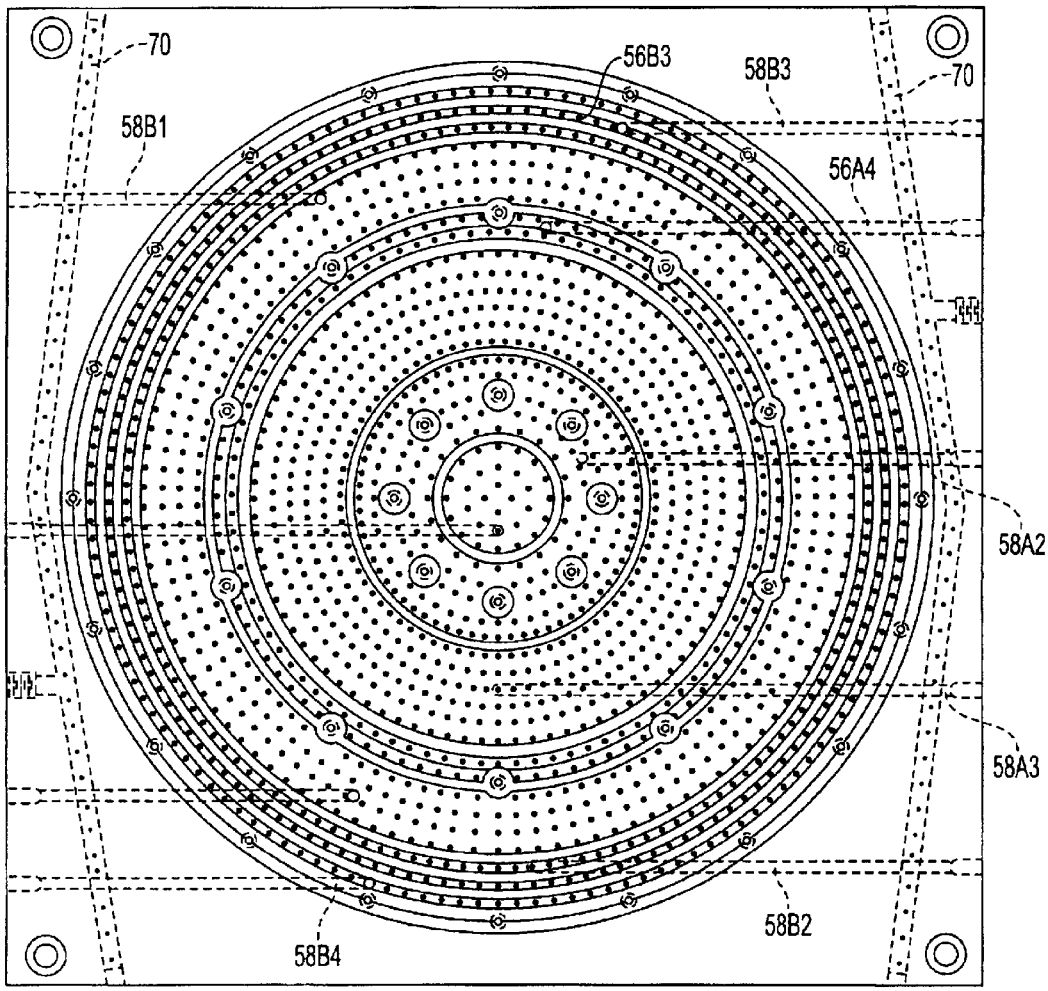
FIG. 2 illustrates a preferred embodiment of a platen support according to the present invention.

In order for the platen support 50 to dispense with a pressurized fluid that can control the amount of polishing of a predetermined area of a wafer, the openings 54 are configured into a patterned arrangement, preferably forming a concentric pattern of openings as shown in FIG. 2, with different ones of the concentric openings being grouped together in separate groupings 56 in a manner that allows for the separate and independent control of ejected fluid in each grouping 56. As described hereinafter, this allows a different amount of pressurized fluid, including no pressurized fluid, to be emitted from the openings of a group 56 to the corresponding portion of the polishing pad 30, and thus the corresponding part of the front surface 12 of the wafer 10. In this regard, since during polishing, the pad 30 is preferably moving bi-linearly, although unidirectional movement could also be used, and the wafer 10 is rotated by the wafer carrier 40, the portions of the front surface 12 of the wafer 10 where polishing can be controlled are various concentric rings, corresponding to the position of the groups 56. It is noted that even if the groups 56 are not fashioned in a concentric arrangement, the rotation of the wafer 10 will result in the corresponding portions of the front surface 12 of the wafer 10 that are controlled nevertheless being various concentric rings.

Where openings 54 are needed and how many different groups 56 of openings 54 are needed will depend, in part, upon the manner which the polisher 20 is being used. Further, the size and number of holes 54 can vary, although the illustrated holes in FIG. 2 is illustrative, but is not intended as limiting. Other grouping arrangements than concentric circles of holes can be used, although if the wafer is rotated during polishing the corresponding portions that can be controlled will be limited as noted above.

As shown in FIG. 2, the openings 54 are arranged for notational purposes in groups that are separately and independently controlled at the subgroup level. Thus, two groups 56A and 56B exist, and subgroups of groups 56A and 56B exist. Illustrated are subgroups 56A1, 56A2, 56A3, and 56A4, as well as subgroups 56B1, 56B2, 56B3 and 56B4. As shown, air lines 58*xx* (with the xx corresponding to the subgroup) that are separately and independently controlled connect to each subgroup.

If a combination of fluids, such as both air and water, is ejected through different openings 54, it is then preferable to have one of the fluids emitted from certain ones of the groups 56 or subgroups 56*x*, and the other fluid emitted through other ones of the groups 56 or subgroups 56*x*.

FIG. 2 also illustrates two rows of openings 70, each of which are designed to eject water, even if the holes 54 are ejecting air, in order to prevent polisher 20 byproducts from reaching the holes 54.

According to the invention, the greater pressure that is applied through holes 54 within groups 56A allow for a polishing rate that is faster with respect to the concentric areas of the front surface 12 of wafer 10 that correspond to the groups 56A than concentric areas that correspond to the groups 56B. Due to the flexibility of the pad 30, a differentiation between areas that are 1–5 mm apart can be made. In contrast, the combination of a pad attached to an endless loop belt such as described in U.S. Pat. No. 5,916,012 mentioned above does not provide for such precision. Thus, according to the present invention, the rate of polishing at any given point on the pad 30 can be obtained by the equation:

$$R=k\times P\times v \quad 1)$$

where R is the rate of polishing, k is a constant that pertains to materials used, such as the chemistry and pad material, P is pressure, and v is the velocity.

While for a bilinearly moving pad 30 the velocity changes in a periodic manner as described below, this averages to an essentially constant velocity. Similarly, a linearly moving endless loop or other type of pad, the velocity will be either constant or will average out to be essentially constant. Thus, the removal rate varies in dependence on changes in pressure P, with the rate of removal corresponding to differences in pressure, such that if the pressure is changed locally on the wafer as described herein, then the removal rate is controlled locally. Accordingly, the pressure differential that will create the difference in polishing rate on various areas of the wafer corresponds to the difference in pressure of the fluid emitted from the holes 54 in the various groups 56. Thus, for example purposes only, using a pad 30 as described above that is flexible, at speeds that range between 0 and 500 ft/min, during a preferably periodic time such as 60 cycles per minute, pressures of fluid emitted from holes 54 in different groups that vary from each other in a range of 0–1 psi can affect the local removal from 0–2000 angstroms per minute of polishing.

Pressures out of the holes 54 will typically be in the range of 0.1 to 5 psi, with a variance in pressures from different groups of holes 56 that is typically in the range of 0–1 psi in order to effectuate the differences in polishing rage on different areas of the wafer 10 corresponding to the different groups 56.

Figure 3:
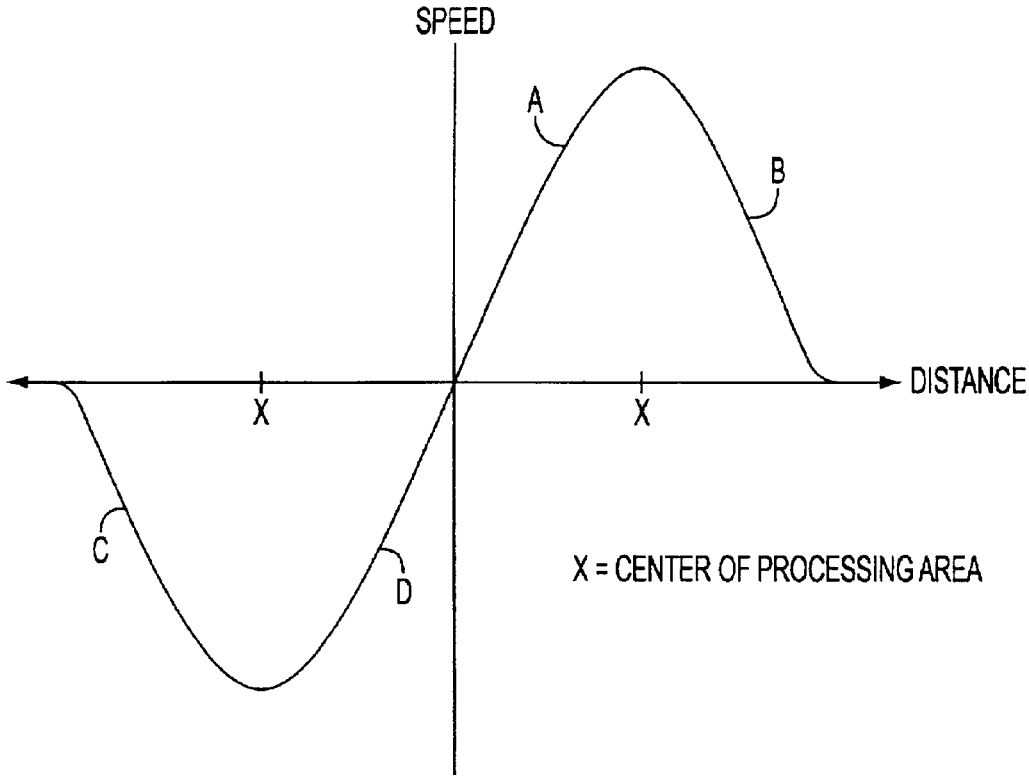

The preferred bi-linear movement of the pad 30 is preferably moved in a periodic manner, with each point on the pad 30 continually oscillating through cycle in the forward and reverse directions as illustrated in FIG. 3. Each point on the pad 30, from a still position, increases in velocity to a maximum in one (forward) direction, then decreases in velocity to zero, then increases in the other (reverse) direction, and then decreases in velocity to zero. Therefore there are instances when the portion of the pad 30 within the processing area stops and then starts to accelerate. In contrast, constantly fast moving (typically linear) and heavy belts such as in the '012 patent make it more difficult to control pressure differentials that cause a discernable change in polishing rate because of the inertia of the fast moving and heavy belt. However, pressure differential can be reflected efficiently using a pad 30 such as in the present invention, and particularly when the pad 30 stops and then starts to accelerate using a non-constant velocity (which speeds up, slows down, speeds up, slows down . . . ), and even more particularly the bi-linear motion according to the present invention. As a result, friction becomes the highest between the wafer 10 and the pad 30, and also the pressure differential is the largest, when there is no movement between the pad 30 and the wafer 10 at the moment directions are being reversed. The end result is very efficient reflection of pressure differential into material removal rate.

Figure 4:
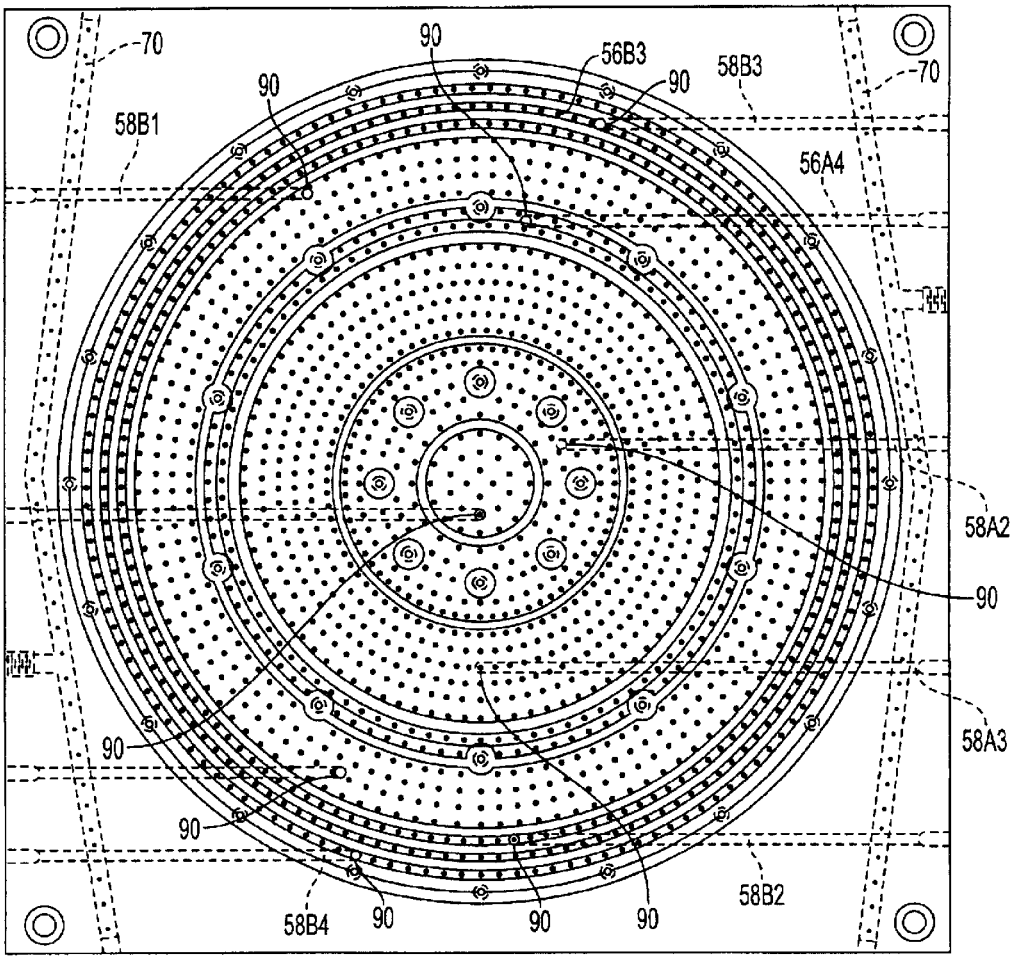
FIG. 4 shows an arrangement of sensors disposed at various locations corresponding to the different regions of the same wafer, which correspond to the different groups of holes of the platen support according to the present invention.

FIG. 4 further illustrates the location of sensors 90 (with respect to the different regions, although it is understood the sensors will be disposed below the pad 30 and directed upwards toward the top surface of the wafer 10) that are used to obtain a thickness, uniformity or endpoint at each of the different regions, and which can also be used to detect the type of material that is currently being removed from the front surface 12 of the wafer 10. U.S. patent application Ser. No. 09/976,469 filed on Oct. 12, 2001 and entitled "Endpoint Detection in Chemical Mechanical Polishing System" and U.S. patent application Ser. No. 10/052,475 filed on Jan. 17, 2002 and entitled "Endpoint Detection in Chemical Mechanical Polishing System describe the implementation and usage of such sensors, and are expressly incorporated herein by reference. Significant for purposes of the present invention, however, is the inclusion of such a sensor 90 at a position corresponding to each of the different groups 56. Such a sensor 90 is not necessarily needed at a location corresponding to each group 56, in which case averaging or other approximation techniques can be used to estimate profiles between locations where sensors 90 are located. Having at least one sensor within each group, however, and preferably having sensors that are spaced at periodic intervals, allows the signals obtained to be used by a controller, such as a microcontroller or other processor operating under the control of a application program, to regulate the amount of fluid emitted from the openings 54 from each of the groups 56, to thereby obtain the desired profile.

The usage of such sensors is particularly advantageous in conjunction with operations in which various different polishing solutions, such as polishing agents without abrasives or slurries with abrasives, are being used to sequentially remove different layers on a wafer, such as a top copper layer with one polishing solution and another lower layer, such as a barrier layer, with a different polishing solution. The usage of different polishing solutions for different layers is described in U.S. application Ser. No. 10/387,698 filed on Mar. 13, 2002 and entitled "Method And Apparatus For Integrated Chemical Mechanical Polishing Of Copper And Barrier Layers," which is hereby expressly incorporated by reference. Significant to the present invention is the usage of the precise polishing control over different regions on the front surface 12 of the wafer 10, so that each layer, such as a top copper layer, can have the copper removed from the entire wafer in a planar manner, by dynamically altering the pressure of the emitted fluid through holes 54 associated with different groups 56. Thereafter, preferably a rinse can occur, and then another polishing solution introduced to remove the layer therebelow. The pressure of the emitted flow through the holes 54 associated with the different groups 56 can again be altered to ensure that the removal of the next layer, such as the barrier layer, again proceeds uniformly over the entire wafer.

Although various preferred embodiments have been described in detail above, those skilled in the art will readily appreciate that many modifications of the exemplary embodiment are possible without materially departing from the novel teachings and advantages of this invention.

What is claimed is:

1. An apparatus that is capable of providing for an adjustable thickness profile to a workpiece comprising:

a workpiece holder for holding the workpiece such that a frontside of the workpiece is exposed within a processing area;

a flexible polishing pad that has a frontside adapted to contact and establish linear movement with the front face of the workpiece, the flexible polishing pad being made of a single body material and having a thickness of less than 20 mils; and a fluid emitter capable of providing fluid through a plurality of holes to the backside of the flexible polishing pad within the processing area, the plurality of holes arranged in a plurality of groups, such that each group contains a different plurality of holes and a difference in pressure causing a difference in polishing rate on correspondingly different areas of the frontside of the workpiece.

2. The apparatus according to claim 1 wherein the flexible polishing pad has abrasives impregnated into the single body material.

3. The apparatus according to claim 2 wherein the flexible polishing pad is formed of a single layer.

4. The apparatus according to claim 2 wherein the flexible polishing pad is formed of a polymer.

5. The apparatus according to claim 1 wherein the flexible polishing pad is nonabrasive.

6. The apparatus according to claim 5 wherein the flexible polishing pad is formed of a single layer.

7. The apparatus according to claim 5 wherein the flexible polishing pad is formed of a polymer.

8. The apparatus according to claim 1 further including:

a plurality of sensors that each emit signals indicative a wafer characteristic; and a controller that receives each of the signals and uses each of the signals to determine the pressure for each of the holes corresponding to each group.

9. The apparatus according to claim 8 wherein the plurality of sensors is aligned with the plurality of groups.

10. The apparatus according to claim 9 wherein the plurality of groups is concentric.

11. A method of polishing a workpiece comprising the steps of:

attaching a frontside of a workpiece to contact within a processing area a frontside of a flexible linearly moving pad made of a single body material and having a thickness of less than 20 mils; and emitting fluid in the processing area through a plurality of different regions to a backside of the flexible moving pad to obtain a pressure on the backside of the flexible moving pad and a difference in pressure between at least two adjacent regions of the plurality of different regions, the difference in pressure thereby causing a difference in polishing rate on correspondingly different areas on the frontside of the workpiece.

12. The method according to claim 11 wherein the step of attaching includes the step of rotating the wafer.

13. The method according to claim 12 wherein the step of emitting fluid emits air from a plurality of holes formed in the platen.

14. The method according to claim 13 wherein the flexible pad is impregnated with abrasive particles.

15. The method according to claim 13 wherein the step of attaching further includes the step of introducing a polishing solution onto the frontside of the wafer within the processing area.

16. The method according to claim 15 wherein the step of attaching further includes the step of introducing a polishing agent with no abrasive particles disposed therein onto the frontside of the wafer within the processing area.

17. The method according to claim 13 wherein the flexible pad is nonabrasive.

18. The method according to claim 17 wherein the step of attaching further includes the step of introducing a slurry onto the frontside of the wafer within the processing area.

19. An apparatus that is capable of providing for an adjustable thickness profile to a workpiece comprising:

a workpiece holder for holding the workpiece such that a frontside of the workpiece is exposed within a processing area;

a flexible polishing pad that has a frontside adapted to contact and establish linear movement with the front face of the workpiece, the flexible polishing pad being made of a single body material and having a thickness of less than 20 mils;

a fluid emitter capable of providing fluid through a plurality of holes to the backside of the flexible polishing pad within the processing area, the plurality of holes arranged in a plurality of groups, such that each group contains a different plurality of holes and a difference in pressure causing a difference in polishing rate on correspondingly different areas of the frontside of the workpiece; and another group of holes configured to emit another fluid.

20. The apparatus of claim 19 wherein the another fluid is a cleaning fluid.

21. The apparatus of claim 19 wherein the another fluid is water.

22. A method of polishing a workpiece comprising the steps of:

attaching a frontside of a workpiece to contact within a processing area a frontside of a flexible linearly moving pad made of a single body material and having a thickness of less than 20 mils;

emitting fluid in the processing area through a plurality of different regions to a backside of the flexible moving pad to obtain a pressure on the backside of the flexible moving pad and a difference in pressure between at least two adjacent regions of the plurality of different regions, the difference in pressure thereby causing a difference in polishing rate on correspondingly different areas on the frontside of the workpiece; and emitting a second fluid from a row of openings.

23. The method of claim 22 wherein the second fluid is cleaning fluid.

24. The method of claim 23 wherein the cleaning fluid is water.

* * * * *